US005505172A

United States Patent [19]

Heitland et al.

[11] Patent Number: 5,505,172

[45] Date of Patent: Apr. 9, 1996

[54] PROCESS AND DEVICE FOR A TWO-STROKE COMBUSTION-ENGINE

[76] Inventors: Herbert H. Heitland, Waldhof 3A, Wolfsburg 38446, Germany; Krzysztof Wislocki, Na Stoku 21, Poznan 61-680, Poland

[21] Appl. No.: 201,108

[22] Filed: Feb. 23, 1994

[30] Foreign Application Priority Data

Feb. 23, 1993 [DE] Germany ..... 43 05 468.4

[51] Int. Cl.[6] ..... F02B 17/00; F02B 19/16

[52] U.S. Cl. ..... 123/257; 123/65 PE; 123/295

[58] Field of Search ..... 123/65 PE, 65 VB, 123/65 W, 73 C, 257, 269, 289, 295, 301, 430, 668

[56] References Cited

U.S. PATENT DOCUMENTS

| | | | |
|---|---|---|---|
| 1,644,517 | 10/1927 | Eiermann | 123/269 |
| 2,211,936 | 8/1940 | Radelet et al. | 123/65 VB |
| 4,106,439 | 8/1978 | Kanao | 123/430 |
| 4,800,853 | 1/1989 | Kraus et al. | 123/668 |
| 4,872,433 | 10/1989 | Paul et al. | 123/257 |
| 4,920,932 | 5/1990 | Schlunke | 123/73 C |
| 5,190,006 | 3/1993 | Motoyama et al. | 123/73 C |
| 5,322,044 | 6/1994 | Maebashi | 123/73 C |

FOREIGN PATENT DOCUMENTS

| | | | |
|---|---|---|---|
| 246607 | 5/1912 | Germany . | |
| 338985 | 7/1921 | Germany . | |
| 395989 | 8/1924 | Germany . | |
| 598226 | 6/1934 | Germany . | |
| 3644747 | 7/1988 | Germany . | |
| 4025556 | 2/1992 | Germany . | |
| 3-271519 | 12/1991 | Japan | 123/65 PE |

*Primary Examiner*—Tony M. Argenbright
*Attorney, Agent, or Firm*—Cohen, Pontani, Lieberman, Pavane; Christa Hildebrand

[57] ABSTRACT

A method and apparatus of a two-stroke combustion engine is provided. The invention relates to utilizing the compression of the flue gases that remain in the cylinder, and the intake of a combustible air-fuel mixture in a limited zone of the combustion chamber, where the mixing of the air-fuel mixture and the flue gas is minimized. The combustible air-fuel mixture is ignited into the limited zone of the combustion chamber.

14 Claims, 2 Drawing Sheets

PROCESS AND DEVICE FOR A TWO-STROKE COMBUSTION-ENGINE

BACKGROUND OF THE INVENTION

1. Field of the Invention

The invention relates to a Working Procedure for a Two-Stroke Combustion-Engine as well as Two-Stroke Combustion-Engines for the realisation of this working Procedure.

2. Discussion of the Prior Art

Todays combustion engines for vehicles have a number of disadvantages, caused by its working procedures. Especially spark fired engines with power control by throtteling have low part-load-efficiencies. Due to the high combustion-pressures and temperatures, also at part-load, the exhaust-gas contains a high amount of nitrogen-oxides, as well in spark fired engine (Otto-engines) as in engines with self ignition (Diesel-engines). In modern Diesel/engines nitrogen-oxide emissions will be reduced already by exhaust gas recirculation. The extraction of the flue gas out of the combustion chamber and the followed recirculation leads to aerodynamic losses. The combustion of the combustible air-fuel-mixture inside the combustion chamber along a very thin flame front (Flame Transversing the Charge=FTC) leads often to uncomplete combustion, resulting again in efficiency losses and unburnt hydrocarbons in the exhaust gas. Often the flame gets quenched close to the piston- or cylinder walls (wall quenching effect), again increasing the amount of unburned hydrocarbons. It is necessary to reduce them with oxidation-catalysts. Furthermore, todays' engine can run only with a very specific fuel developed from the restricted petroleum resources and not with alternative fuels, having a much larger potential for the protection of the environment than the fossil fuels of today.

SUMMARY OF THE INVENTION

It is the object of the invention, to create a new method of operating a two-stroke-engine, in which all the above named disadvantages of the known engines of today can be reduced or avoided.

The object of the present invention is to provide a process and apparatus for 1. compression of the exhaust gases remaining in the cylinder,
2. intake of a combustible air-fuel-mixture in a limited zone of the combustion chamber, where the mixing of the air-fuel-mixture and the exhaust gas will be minimized,
3. ignition of the combustible air-fuel-mixture into the limited zone of the combustion chamber,
4. expansion of the cylinder charge and
5. controlled discharge of a given exhaust gas quantity, which equals the exhaust gas quantity, produced by the combustion of the air-fuel-mixture introduced into the cylinder in the following cycle.

In accordance with the first step after the discharge rest-exhaust gases remain in the cylinder which will be compressed. A combustible air-fuel mixture will be brought into these exhaust gases, where a mixing should be prevented so that a complete combustion after the ignition should be guarenteed. The released heat during the combustion of the air-fuel mixture goes as well into the mixture as also into the exhaust gas. Therefore the total temperature- and pressure rise within the combustion chamber is smaller than with a conventional combustion of a homogenous mixture. Thus, the formation of nitrogene-oxids is reduced and in a very lean mixture, it is completely prevented. After the expansion of the cylinder-charge in the region of BDP (bottom dead point) of the piston, only that amount of exhaust gas will be discharged, which is formed in the following cycle by the combustion of the air-fuel mixture, brought into the cylinder. With this selective discharge of the unavoidable amount of exhaust flue-gas, a reduction of the aerodynamic losses at partload is obtained. This reduction exists even in comparison with the unthrottled Diesel-engines, where the total charge in the cylinder always has to be discharged.

The load control in the method according to the invention is obtained alone by the quantity of the air-fuel mixture brought into the cylinder without throttling, as needed in conventional spark-fired-engines. The volume of exhaust gas which must be discharged for the cylinder is the exhaust flue gas volume, which the combustion product of the air-fuel mixture are having under outlet-conditions of pressure and temperature. While outlet temperature and pressure might fluctuated by load, it is possible that the theoretical discharge-exhaust gas volume might briefly deviate from the real one. These deviations are insignificant as long as, at the same load, for a longer period of working cycles, the mass balance equals zero. The control of the discharge of the given amount of exhaust gases can be reached by aid of the shut-off-system in the exhaust pipe, in using a suitable measuring device similar to the known engine control devices by using the loadpoints of pressure/engine-speed diagramms.

While the combustion takes place in the middle of the cylinder and is well separated from the walls, the flame can not be wall-quenched, therefore less unburnt hydrocarbons remain in the exhaust gas. Furthermore the exhaust gases remain at the wall, and soften the noise transmission from the combustion zone to the piston- and cylinderwall, so that the noise production of the engine will be reduced. Due to the intake of the combustible air-fuel/mixture into the relatively hot cylinder filled with exhaust gases, the working-procedure of the invention is very suitable for engine-operation with self-ignition and also for the use of alternative fuels.

A wide range of different fuels can be burnt in the same engine (multi-fuel-capability).

Preferably the expansion of the cylinder-charge takes place in such a way, that the burning gases do not mix with the exhaust gases in the lower and outer regions of the combustion chamber. So it is ascertained, that the freshly burnt gases remain in the next cycle in the cylinder, whereas only the old exhaust gases are getting discharged. According to the method of the invention, the fresh exhaust gases remain for the next cycles in the cylinder, it is possible that unoxidized or only partly oxidized hydrocarbons are after-treated even in the engine and the exhaust gas containing molecules of nitrogen oxides might favorably react in this exhaust gas layer with the hydrocarbons to form harmless components.

For minimizing the mixing process of the air-fuel-mixture with the exhaust gas layer as well as the unwanted mixing-process of burning gases with the exhaust gas at the expansion, two solutions will be considered. First, one solution provides that the exhaust gases essentially leave the cylinder in a tangential flow, and create a swirl flow for the remaining exhaust gases in the cylinder and bring the air-fuel mixture centrally into the swirl. The other solution provides bringing the air-fuel mixture into a pre-combustion chamber situated centrally in the upper region of the cylinder and enclosed with a piston bowl at TDC of the piston, allowing at expansion of the combustion gases to flow axially out of the pre-combustion chamber into the piston bowl and, thereafter, radially out of the piston bowl to the exhaust ports in the cylinder wall.

In the method of operation the separation of the mixture from the exhaust gases is obtained with aerodynamic means like swirl production, similar to the known procedure of stratified charge engines. Here, the discharged exhaust flue gas flow mainly in a tangential way out of the cylinder in order to create a circular swirl in the remaining exhaust gases. The air fuel mixture is centrally injected into the swirl flow and takes up only slowly the swirl motion due to the inner friction at the border area between the fresh charge and the exhaust gas. They remain due to the centrifugal forces in the outer region of the combustion chamber. Also after the combustion due to the larger swirl of the exhaust gas the concentration in the neighborhood of the cylinder wall remain high and the hot combustion products remain during the expansion mainly in the middle of the cylinder. In this way it is secured, that during discharge mainly the old exhaust gases flow out of the cylinder and the new combustion products remain for another working cycle in the combustion chamber. With a piston crown having a central tray, whereby the outer skirt of the piston together with the innerwall of the cylinder head forms a narrow gap at TDC (Top Dead Center of the piston) and when the exhaust gases are pressed out of this outer region, the swirl-velocity increases (quench-effect).

With the method the air-fuel mixture will be separated from the exhaust flue gas remaining in the cylinder. For this purpose the air-fuel mixture is brought into a pre-combustion chamber in the upper region of the cylinder, where the remaining exhaust gases in this cavity are pushed out by the air-fuel mixture through a small opening hole axially downwards out of the pre-combustion chamber into the main combustion chamber. At the combustion also the combustion products flow through this opening hole axially into a tray in the piston crown which sourround the pre-combustion chamber at TDC of the piston. Afterwards the combustion products flow along the piston-contour to the outlet-ports in the cylinder wall. The mixing of the combustion products with the exhaust gases is here also very small, therefore the exhaust gas exists mainly of the exhaust gases of the previous cycles and the combustion products remain for the next cycles in the cylinder.

There are several different methods for the intake of the air-fuel mixture. Similar to the Diesel-injection-system it is possible that a given air quantity is brought into the limited zone of the combustion chamber, into which afterwards the fuel quantity is injected. Alternatively fuel together with compressed air can be blown into the limited zone of the combustion chamber. In the preferred embodiment a given air quantity is blown into the limited zone of the combustion chamber and the fuel is injected into a small pre-mix chamber, in which together with a small amount of air, previously brought into this chamber, a rich air-fuel mixture is formed, which is heated up by the hot walls of the pre-mix chamber, thus, producing first reactions. This reacting gas mixture together with compressed air is then blown into the limited zone of the combustion chamber, so that the produced radicals during this reaction will be uniformly distributed in the limited zone. With this procedure by self- or spark ignition a so-called turbulent pulsed jet combustion (PJC) gets organized. Similar systems, e.g. the so-called PJC-Generator-System oder the Pulsed Air Blast Atomizer are prescribed by A. K. Oppenheim in the paper "The Future of Combustion in Engines", International Conference on Combustion in Engines, I. Mech. E, London 1992. Here it is also mentioned that the PJC- combustion leads to a much more rapid combustion of the mixture as it is the case in conventional combustion procedures and the exhaust gas has a much lower concentration of harmfull substances. The steep pressure rise obtained with the PJC-combustion will be softened by the exhaust gas mantle sorrounding the combustion zone, when the combustion noise is spread out to the piston- and cylinder walls.

Two-stroke combustion engines according to the method can be described as follows: the mixture/rest-gas-separation is due to the lower section of the cylinder wall equipped with outlet ports for the tangential removal of the exhaust gas and an intake-system for the air fuel mixture in the central section of the cylinder head, where a shut-off-device is situated in the exhaust gas pipe. The intake-system for the air-fuel-mixture is preferably an air-blast injector for the generation of a PJC-combustion. With aid of a piston crown having a circular tray, the swirl in the cylinder-charge becomes stronger due to the quench effect.

The two-stroke combustion engines for the execution of the method has in the central region of the cylinder head a pre-combustion chamber with an axial outlet opening directed downwards, attached with an air intake channel and a fuel intake system. The piston has a circular tray, which enclosed at TDC the pre-combustion chamber. The outskirt of the upper part of the piston has a distance to the cylinder wall and at BDP the lower part of the piston closes at least partly the exhaust portholes. This method prevents, during the expansion, the combustion product from flowing directly to the cylinder wall. To control the discharge of the given exhaust gas amount in the exhaust pipe a controllable shut off system is situated. This shut-off-system can be a rotary valve connected to the crankshaft, whereby the rotary angle between the crankshaft and the rotary valve can be changed. The rotary angle can be adjusted in such a way, that at open outlet-ports the rotary valve is only partly open, and therefore at partload only a small amount of exhaust gas can be discharged. When the opening of the rotary valve is synchronized with the outlet-ports, the engine runs at fulload.

Alternately, every other electronically controlled valve is capable for controlling the engine-load e.g. as a function of pressure and engine-speed. A further improvement of the efficiency can be reached with a procedure, that the piston wall and cylinder wall, forming the combustion-chamber, exist out of heat resistant material like ceramics or at least have a layer of such material.

DESCRIPTION OF THE PREFERRED EMBODIMENTS

Figure 1A:
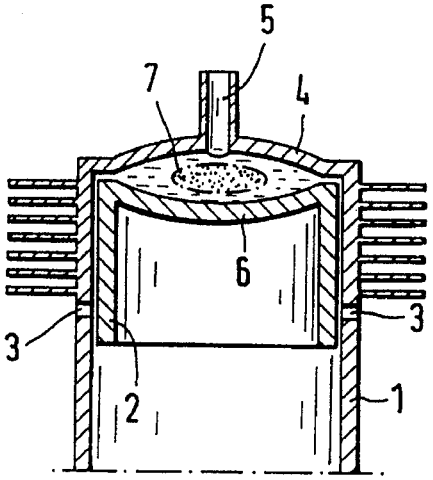
FIGS. 1*a*, 1*b*, 2*a*, 2*b*, 3*a* and 3*b* show the systematic presentation of a two-stroke-combustion engine in side-view (a) and ground-view (b) in sectional presentation at different piston positions
Figure 1B:
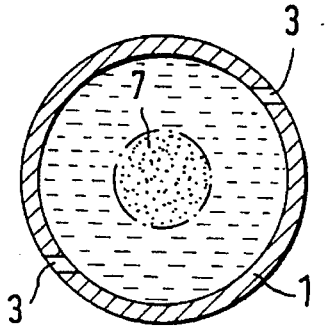
Figure 2A:
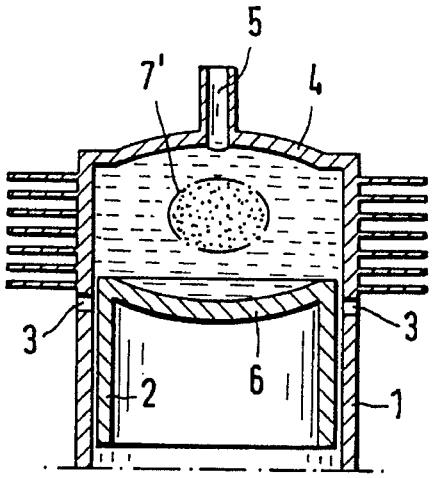
Figure 2B:
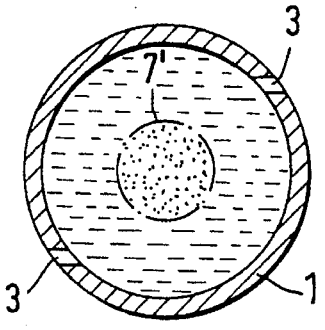
Figure 3A:
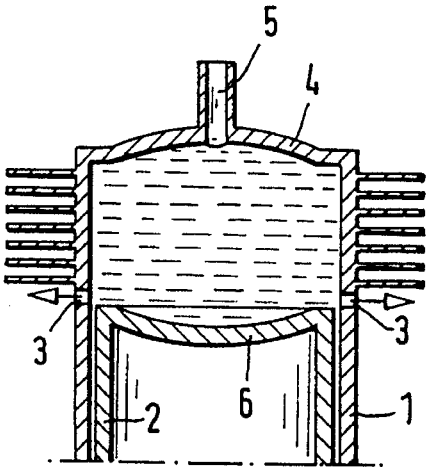
Figure 3B:
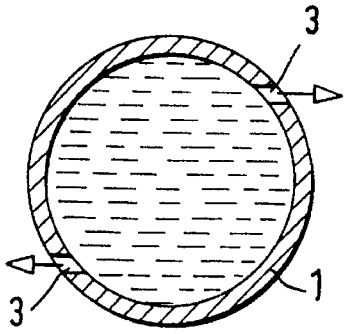
Figure 4:
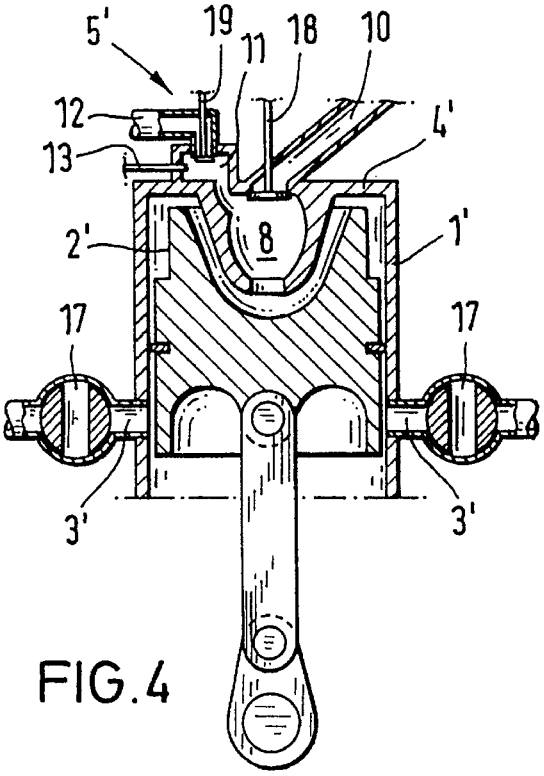
FIGS. 4 to 7 show the systematic presentation of a two-stoke-combustion engine in sectional side-view at different rotational angles of the crank shaft.
Figure 5:
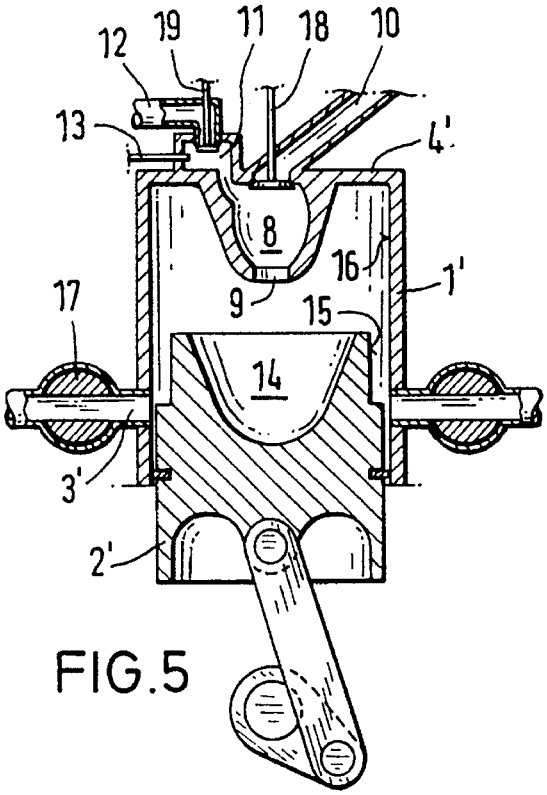
Figure 6:
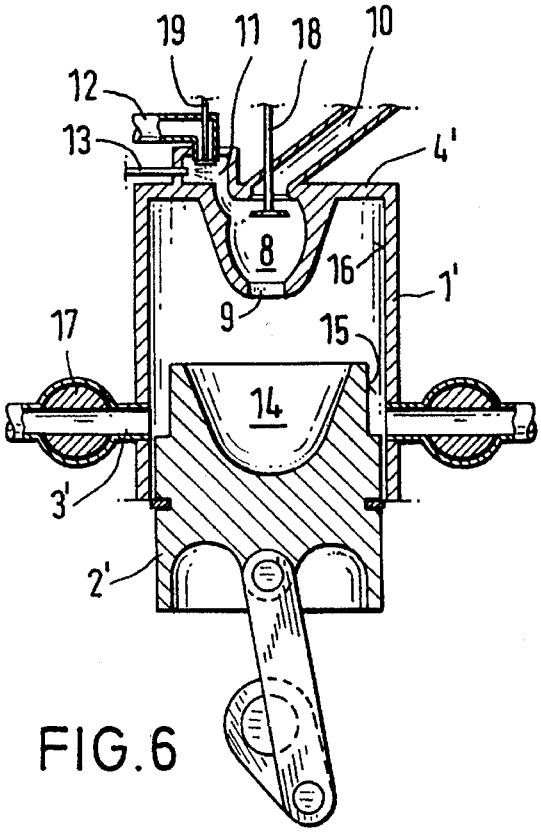
Figure 7:
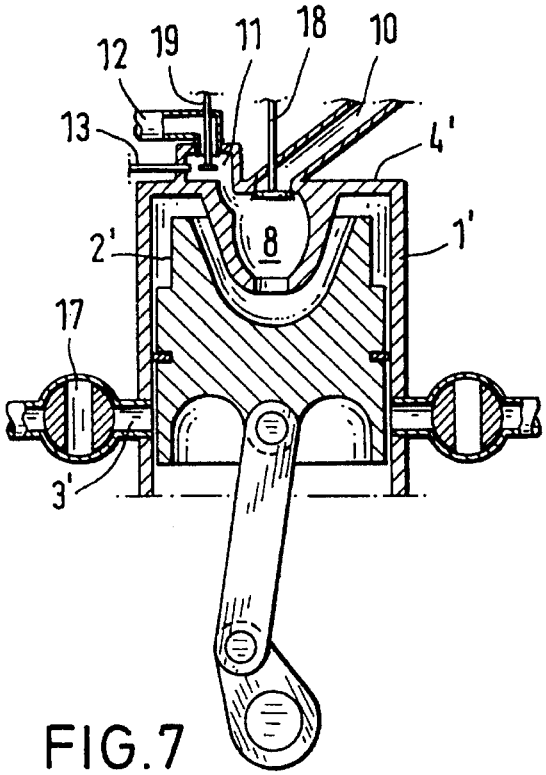

In FIG. 1 to 3 the cylinder 1 and the piston 2 of the two-stroke combustion engine is presented systematically. In cylinder 1 in the lower region of the combustion chamber lead the tangential outlet ports 3. The controllable shut-off device in the exhaust-pipes following the outlet-ports 3, are not presented in these figures. In the central region of the cylinder head 4 the intake device 5 for the air-fuel mixture is presented in a systematical way. For example, it can be a pressure intake port, controlled by a valve, in combination with a conventional Diesel-injection nozzle. Prefarably the intake device 5 can consist of an air blast nozzle, which blows the fuel together with compressed air into the combustion-chamber.

At one cycle at first the rest-fluegases, swirling inside the cylinder, will be compressed, whereas the swirl of the exhaust gases becomes stronger, when the fluegases is squeezed out of the outer region area of the combustion chamber. This quench effect will be produced, because as well the cylinder head 4 as the piston crown 6 have a circular tray, whereby the outer region of the cylinder head 4 together with the piston 2 (FIG. 1) form a narrow gap at TDP of the piston.

During the compression with the intake device 5 the air-fuel mixture charge 7 is blown into the combustion chamber, which is filled with exhaust gases. While the air-fuel mixture charge does not participate in the swirl flow, only at the random of the spray a mixing with the rest-flue gases take place.

During the expansion stroke the burning mixture charge 7' is expanded (FIG. 2), but also here a further mixing with the rotating exhaust gases is negligiable. Especially close to the wall of the cylinder 1 the concentration of the exhaust gases is very high. Therefore at the outlet of the given amount of exhaust gas at BDC of the piston (FIG. 3) mainly the old exhaust gases are discharged, whereas the newly produced combustion products remain in the central region of cylinder 1.

In FIG. 4 to 8 the two-stroke combustion engine together with the attached pre-combustion chamber 8 in the cylinder head 4' is presented. The pre-combustion chamber 8 has an axial opening hole 9, which leads into the cylinder 1'. The mixture injection device 5' contains a valve-controlled air-supply channel 10 and a fuel-intake device, having a pre-mixing-chamber 11, attached with a valve-controlled supply line for compressed air 12 and a fuel-injection-nozzle 13.

In the piston crown is a large circular tray, which at TDP of the piston enclosed the pre-combustion chamber 8. The outskirt of the lower part of the piston covers the outlet-ports 3' in axial direction and the upper part of the piston has a radial distance to the cylinder wall 16 so that in the BDP of the piston 2' a flow channel of a ring structure is formed. So it is guaranteed that during the outlet mainly the old exhaust gases are discharged out of the cylinder 1', while the new combustion products remain in the central region of the cylinder 1' and the piston bowl 14.

Finally in FIG. 4 to 8 also the shut-off system 17 is shown, here consisting of rotary valves. They can either be driven directly from the crank shaft or they can be electronicly controlled.

At a working cycle of the combustion engine shown in FIG. 4 to 7 the combustion starts in the region of the TDC of the piston (FIG. 4) by self- or spark-ignition in the pre-combustion chamber 8. The burning gases flow through the opening hole 9 from the pre-combustion chamber 8 into the piston tray 14 of the piston 2' and press the exhaust gases in the combustion chamber into the border regions, especially between the outskirt of the piston 14 and the cylinder wall 16.

In the region of the BDC of the piston 2' (FIG. 5 and 6) at open outlet channels 3' the exhaust gases are driven out of the cylinder 1', when the shut-off valves 17 are open. At full-load the shutt-off system has to be open, as long as the outlet channels 3' are not closed by the piston 2'. In this case some combustion products might flow through the the outlet channels 3' and therefore can not remain in the next combustion cycle in cylinder 1'. When ever possible, this case should be prevented by a precise control of the whole combustion-process.

During the outlet of the exhaust gases valve 18 in the air-intake channels 10 should be open, so that fresh air can flow into the pre-combustion chamber. At the BDC position of the piston p.e. during the compression mode with aid of the fuel-injection. nozzle 13 fuels will be injected into the pre-mix chamber 11. The optimal timing for the fuel-injection, found out by experiments, should be electronically controlled.

During the compression stroke the rich mixture in the pre-mix-chamber 11 is heated up and starts to react. With opening of valve 19 in the intake line for the compressed air 12 the rich air-fuel mixture in which the first radicals are formed, is blown into the pre-combustion chamber 8 (FIG. 4) and will be there ignited. Alternatively the reactions in the pre-mix chamber 11 might be so intensive that the mixture will be already ignited here. The flow-channel between the pre-mix chamber 11 and the pre-combustion chamber 8 is preferably equipped with a check-valve (not shown), to prevent a back-flow of the gases into the pre-mix-chamber 11. After the ignition follows a new expasion stroke.

In all the drawings an ignition-device is not shown, because the engine in accordance with the invention is capable to operate as well with self-ignition as with spark-ignition. The self-ignition according to FIG. 1 to 3 starts in the separation layer of the engine between the mixture 7 and the hot exhaust gases. In the engine in accordance to FIG. 4 to 7 the self-ignition starts at the hot walls of the pre-combustion chamber 8. At the warming-up period a glow-plug is situated either in the region of the limited zone of the combustion chamber 7 where a rich mixture exists, or in the pre-combustion chamber 8. For fuels, which can only be ignited with auciliary devices, the ignition device has to be placed either in the region of the limited zone of the combustion chamber 7 where a rich mixture exists, or in the pre-combustion chamber 8. The ignition device can be a spark-plug or a plasma-jet igniter or any other ignition system.

The working-procedure of the invention is not limited by the two described examples for realisation. Also when using the descriped principles of the invention, the already known stratified charge engine might be modified to the object of the invention, namely by realisation of two-stroke engines with Mixture-Exhaust-Stratified-Charge (MESC-engines).

What is claimed is:

1. A method of operation for a two-stroke combustion engine comprising the steps of (a) compressing the exhaust gases remaining in the cylinder;

(b) intaking of the combustible air-fuel mixture into a limited zone of the combustion space, whereby the mixing of the air-fuel mixture and the exhaust gas is minimized;

(c) igniting the combustible air-fuel mixture in the limited zone;

(d) expanding the cylinder charge; and (e) controlling the exhaust of a given exhaust gas quantity which is equal to the amount of exhaust gas, formed through the combustion of the air fuel mixture brought into the cylinder during the next operation cycle.

2. The method according to claim 1, wherein the expansion of the cylinder charge takes place in such a way that a mixture of the burning gases with the exhaust gases of the lower and outer region of the combustion-space is minimized.

3. The method according to claim 1, wherein the exhaust gases essentially leave the cylinder in a tangential flow, creating a swirl flow for the remaining exhaust gases in the cylinder and bringing the air-fuel mixture centrally into the swirl.

4. The method according to claim 1, further comprising the steps of bringing the air-fuel mixture into a pre-combustion chamber situated centrally in the upper region of the cylinder and enclosing with a piston bowl at TDC of the piston, allowing at expansion of the combustion gases to flow axially out of the pre-combustion chamber into the piston bowl and, thereafter, radially out of the piston bowl to the exhaust ports in the cylinder wall.

5. The method according to claim 1, wherein the intake of the air-fuel mixture comprises the steps of (a) intaking a given air quantity into the limited zone of the combustion chamber and intaking of a given fuel quantity into the air quantity in the combustion chamber.

6. The method according to claim 1, wherein the fuel is blown into the limited zone of the combustion chamber together with compressed air, whereby the air fuel mixture is intensively mixed.

7. The method according to claim 5, further comprising the steps of injecting the fuel into a pre-mixing chamber, wherein the fuel together with the air is forming a rich fuel-air mixture; and blowing the rich fuel-air mixture into the limited zone in the combustion-chamber with aid of compressed air and retaining the piston in the TDC position.

8. A two-stroke combustion engine comprising (a) a cylinder head having a central pre-combustion chamber including an axial outlet hole and being attached to an air supply channel and a fuel supply system;

(b) a piston with its piston-tray surrounding the pre-combustion chamber at TDC, wherein the outside of the upper part of the piston has a distance to the cylinder wall and covers at BDC of the piston the exhaust port holes entering the cylinder at least partly in axial direction; and (c) the exhaust port holes having a controllable shut-off system.

9. The engine according to claim 8, wherein the fuel-intake system is a fuel injection nozzle.

10. The engine according to claim 8, wherein the fuel intake system is an air blast nozzle having a pre-mixing chamber attached to an inlet system for compressed air and a fuel injection nozzle.

11. The engine according to claim 8, wherein the shut-off system comprises a synchronized rotary valve connected to the crankshaft, whereby the angle of rotation of the rotary valve in relation to the crankshaft is variable.

12. The engine according to claim 8, wherein the shut-off system comprises an electronically controlled valve.

13. The engine according to claim 8, wherein the piston walls and the cylinder walls forming the combustion chamber are made of heat resistant material.

14. The engine according to claim 8, wherein the piston walls and the cylinder walls forming the combustion chamber have a layer of heat resistant material.

* * * * *